US011708774B2

(12) United States Patent
Nishitani et al.

(10) Patent No.: US 11,708,774 B2
(45) Date of Patent: Jul. 25, 2023

(54) BLOW-BY GAS TREATMENT APPARATUS

(71) Applicant: ISUZU MOTORS LIMITED, Tokyo (JP)

(72) Inventors: Hitoshi Nishitani, Fujisawa (JP); Kiyoshi Shirato, Fujisawa (JP); Takashi Ishikawa, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 17/636,260

(22) PCT Filed: Aug. 11, 2020

(86) PCT No.: PCT/JP2020/030545
§ 371 (c)(1),
(2) Date: Feb. 17, 2022

(87) PCT Pub. No.: WO2021/039373
PCT Pub. Date: Mar. 4, 2021

(65) Prior Publication Data

US 2022/0290592 A1 Sep. 15, 2022

(30) Foreign Application Priority Data

Aug. 23, 2019 (JP) ..... 2019-152883

(51) Int. Cl.
*F01M 13/04* (2006.01)

(52) U.S. Cl.
CPC ..... *F01M 13/04* (2013.01); *F01M 2013/0427* (2013.01)

(58) Field of Classification Search
CPC ..... F01M 13/04; F01M 2013/0427
See application file for complete search history.

(56) References Cited

U.S. PATENT DOCUMENTS 6,167,849 B1 * 1/2001 Wilson ..... F02M 25/06 123/41.86
2010/0089369 A1 * 4/2010 Bucknell ..... F02D 19/084 123/520

(Continued)

FOREIGN PATENT DOCUMENTS

JP 2006-220120 A 8/2006
JP 2012-102697 A 5/2012

(Continued)

OTHER PUBLICATIONS

Patent Cooperation Treaty, International Search Report, Application No. PCT/JP2020/030545, dated Oct. 2, 2020, in 6 pages.

(Continued)

*Primary Examiner* — Kurt Philip Liethen
(74) *Attorney, Agent, or Firm* — Procopio, Cory, Hargreaves & Savitch LLP

(57) ABSTRACT

A blow-by gas treatment apparatus for an internal combustion engine mounted on a vehicle includes a blow-by gas pipe having a downward facing outlet portion opened to atmosphere, and a collection container into which the outlet portion is inserted and which is configured to collect oil discharged from the outlet portion. The collection container includes an upper end opening portion formed at an upper end of the collection container and into which the outlet portion of the blow-by gas pipe is inserted from above, a discharge hole formed in an upper portion of a rear surface portion of the collection container, the rear surface portion being located on a rear side in a vehicle length direction, and a cutout portion formed at an upper portion of a side surface portion of the collection container, the side surface portion being located on an outer side in a vehicle width direction.

6 Claims, 6 Drawing Sheets

(56) References Cited

U.S. PATENT DOCUMENTS

2012/0048247 A1* 3/2012 Narita ..... F02D 41/18
123/573
2022/0298938 A1* 9/2022 Kavnekar ..... F01M 13/0416

FOREIGN PATENT DOCUMENTS

JP 2016-183604 A 10/2016
JP 2021004591 A * 1/2021

OTHER PUBLICATIONS

Patent Cooperation Treaty, Written Opinion, Application No. PCT/JP2020/030545, dated Oct. 2, 2020, in 3 pages.

* cited by examiner

BLOW-BY GAS TREATMENT APPARATUS

CROSS-REFERENCE TO RELATED APPLICATIONS

This application is US National Stage of International Patent Application PCT/JP2020/030545, filed Aug. 11, 2020, which claims benefit to JP 2019-152883 filed Aug. 23, 2019, contents of both of which are incorporated herein by reference.

TECHNICAL FIELD

The present disclosure relates to a blow-by gas treatment apparatus, and particularly, to a blow-by gas treatment apparatus for an internal combustion engine mounted on a vehicle.

BACKGROUND ART

In an internal combustion engine mounted on a vehicle, there is known a blow-by gas treatment apparatus that releases, to atmosphere from an outlet portion of a blow-by gas pipe, blow-by gas leaking into a crankcase from a gap between a piston and a cylinder.

CITATION LIST

Patent Literature

Patent Literature 1: JP-A-2006-220120

SUMMARY OF INVENTION

Technical Problem

When the blow-by gas is released to the atmosphere in this way, since oil contained in the blow-by gas is also released to the atmosphere from the outlet portion of the blow-by gas pipe, there is a concern that components around the outlet portion and a road surface may be contaminated.

Therefore, the present disclosure has been made in view of such circumstances, and an object of the present disclosure is to provide a blow-by gas treatment apparatus which can prevent components or the like from be contaminated by oil in blow-by gas.

Solution to Problem

According to an aspect of the present disclosure, there is provided a blow-by gas treatment apparatus for an internal combustion engine mounted on a vehicle, the blow-by gas treatment apparatus including:

a blow-by gas pipe having a downward facing outlet portion opened to atmosphere; and a collection container into which the outlet portion of the blow-by gas pipe is inserted and which is configured to collect oil discharged from the outlet portion of the blow-by gas pipe, in which the collection container includes:

an upper end opening portion formed at an upper end of the collection container and into which the outlet portion of the blow-by gas pipe is inserted from above, a discharge hole formed in an upper portion of a rear surface portion of the collection container, the rear surface portion being located on a rear side in a vehicle length direction, and a cutout portion formed at an upper portion of a side surface portion of the collection container, the side surface portion being located on an outer side in a vehicle width direction.

It is preferable that the cutout portion is cut out from a height position of the upper end of the collection container to a position lower than the outlet portion of the blow-by gas pipe.

It is preferable that a plurality of the discharge holes are provided.

It is preferable that the plurality of discharge holes are arranged in a staggered manner.

It is preferable that the discharge hole is formed only in the upper portion of the rear surface portion of the collection container.

It is preferable that the internal combustion engine is vertically disposed in the vehicle, and the collection container is configured to be detachably attached to a side surface portion of a flywheel housing of the internal combustion engine.

Advantageous Effects of Invention

According to the present disclosure, the components or the like can be prevented from being contaminated by the oil in the blow-by gas.

DESCRIPTION OF EMBODIMENTS

Hereinafter, an embodiment of the present disclosure will be described with reference to the accompanying drawings. It should be noted that the present disclosure is not limited to the following embodiment.

Figure 1:
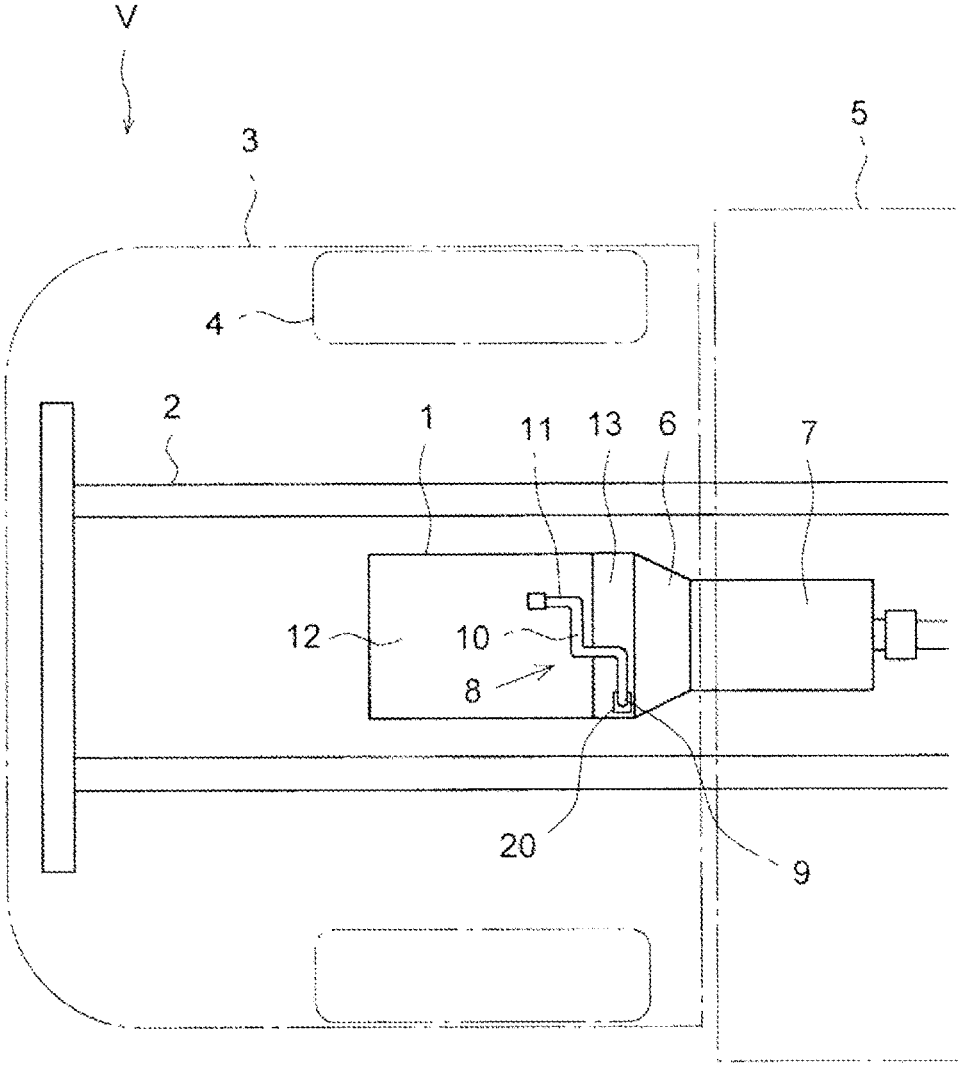
FIG. 1 is a schematic plan view illustrating a vehicle.
Figure 1:
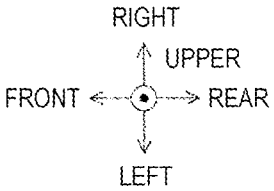

FIG. 1 is a schematic plan view of a vehicle on which a blow-by gas treatment apparatus of the present embodiment is mounted. Front, rear, left, right, upper, and lower directions are as illustrated. A vehicle V is a cab-over truck. However, a type of the vehicle is not limited. The vehicle V includes a ladder frame 2, a cab 3 that defines a passenger compartment, front, rear, left, and right tires 4 (only tires on a front side is shown), and a loading platform 5.

A diesel engine serving as an internal combustion engine (engine) 1 is mounted on the vehicle V in a vertical arrangement. However, a type of the internal combustion engine is not limited. A clutch 6 and a transmission 7 are sequentially connected to a rear side of the engine 1.

The engine 1 includes a blow-by gas treatment apparatus 8. The blow-by gas treatment apparatus 8 includes a blow-by gas pipe 10 having a downward facing outlet portion 9 opened to atmosphere, and a collection container 20 into which the outlet portion 9 of the blow-by gas pipe 10 is inserted and which collects oil discharged from the outlet portion 9 of the blow-by gas pipe 10.

Blow-by gas introduced from a specific portion of the engine 1 flows through the blow-by gas pipe 10. In the present embodiment, the blow-by gas pipe 10 is formed of a rubber hose and is disposed outside the engine 1. However, a material of the blow-by gas pipe 10 can be any material. An inlet portion 11 of the blow-by gas pipe 10 is connected to, for example, a head cover 12, and extracts blow-by gas from the head cover 12. However, an extraction position of the blow-by gas can be changed.

Figure 4:
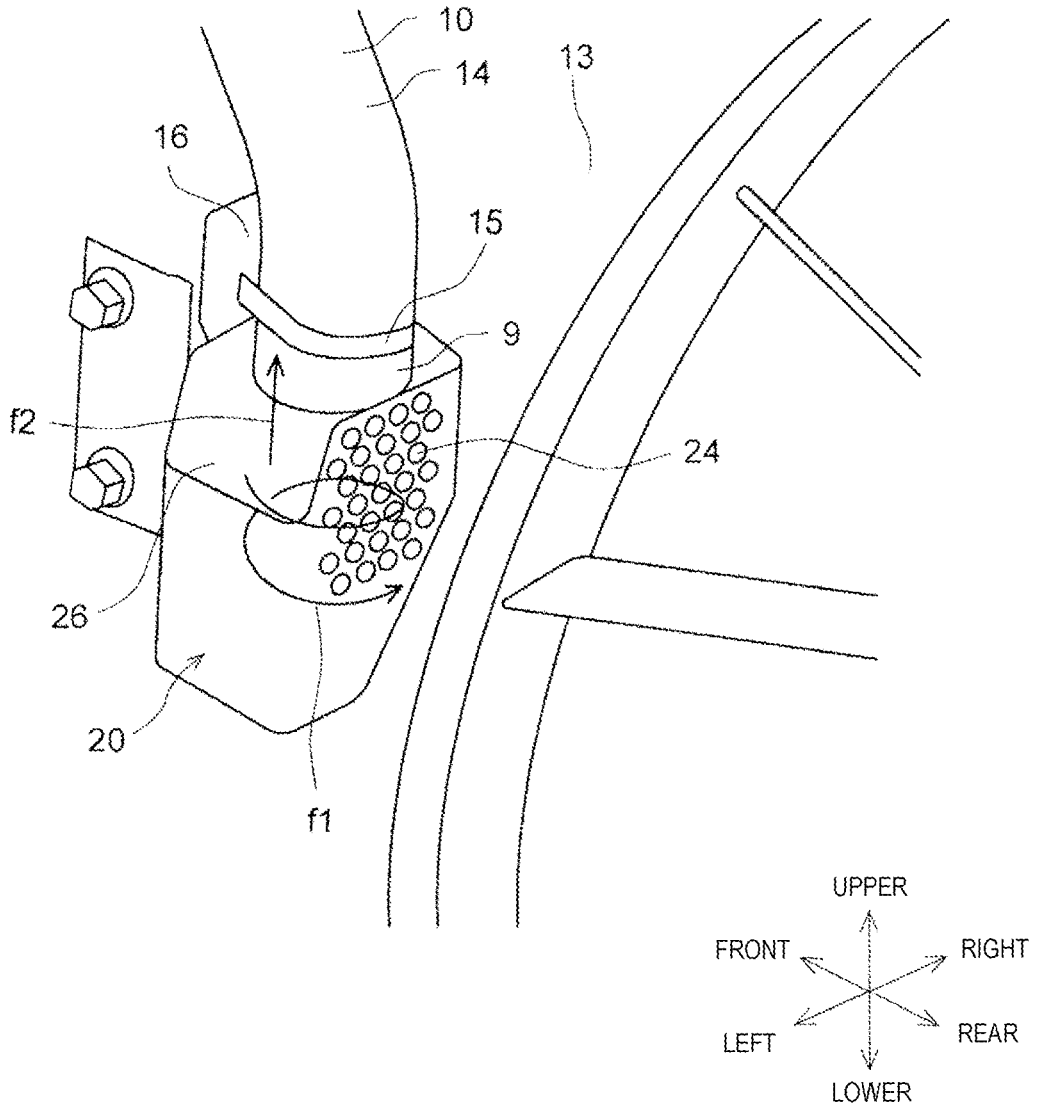
FIG. 4 is a rear perspective view illustrating a flow of gas in an idling stop state.

The outlet portion 9 of the blow-by gas pipe 10 is located at a position of a side surface portion of a cylindrical flywheel housing 13 that accommodates a flywheel (not shown) of the engine 1. Therefore, the collection container 20 is detachably attached to the side surface portion of the flywheel housing 13 such that the oil discharged together with the blow-by gas from the outlet portion 9 can be collected. In the present embodiment, the outlet portion 9 and the collection container 20 are disposed on a left side surface portion of the flywheel housing 13. However, the installation position can be changed, and the outlet portion 9 and the collection container 20 may be disposed on a right side surface portion, for example. An installation state of the outlet portion 9 of the blow-by gas pipe 10 and the collection container 20 is schematically shown in FIG. 4.

Figure 2:
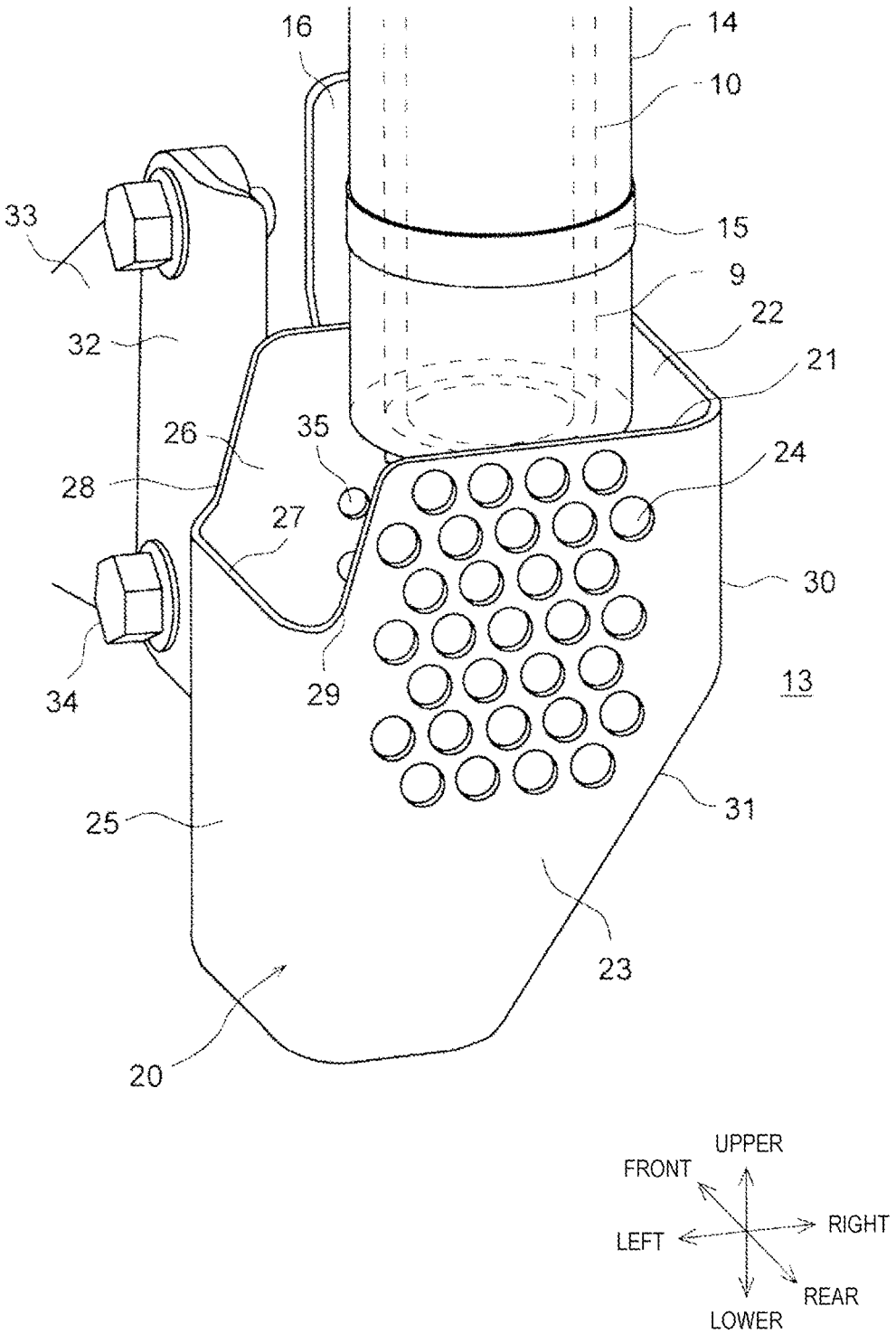
FIG. 2 is a rear perspective view illustrating an outlet portion of a blow-by gas pipe and a collection container.
Figure 3:
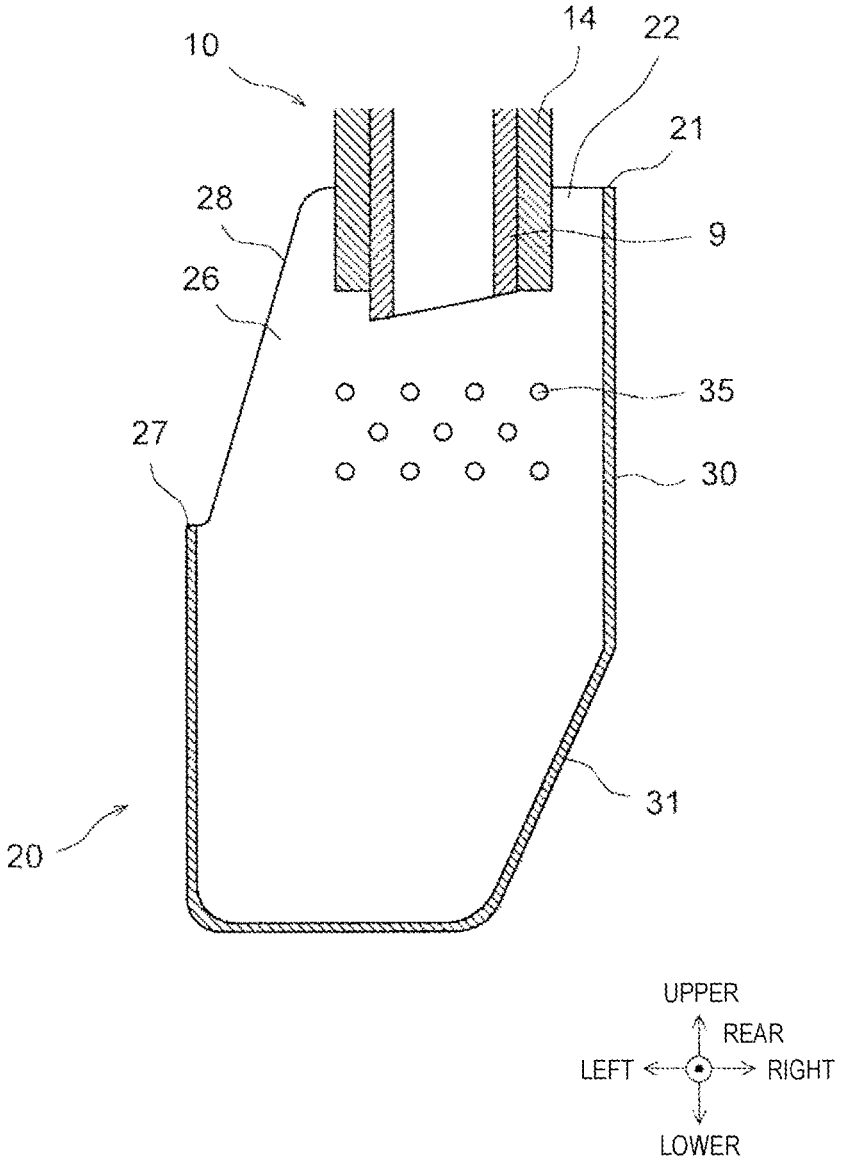
FIG. 3 is a rear cross-sectional view illustrating the outlet portion of the blow-by gas pipe and the collection container.

FIGS. 2 and 3 show the outlet portion 9 of the blow-by gas pipe 10 and the collection container 20 in more detail. The blow-by gas pipe 10 is covered from outside by a heat insulating member 14 made of sponge or the like over an entire length including the outlet portion 9, and thus, the blow-by gas pipe 10 is kept warm. Thus, moisture in the blow-by gas inside the blow-by gas pipe 10 can be prevented from being condensed and frozen at a low outside air temperature, and an inside of the blow-by gas pipe 10 can be prevented from being blocked by ice generated by the freezing.

The outlet portion 9 of the blow-by gas pipe 10 is directed downward. Further, as shown in FIG. 3, an end surface of the outlet portion 9 protrudes from the heat insulating member 14 toward a downstream side (downward) in the blow-by gas flow direction, and is obliquely cut. Thus, the oil flowing down along an inner surface of the blow-by gas pipe 10 (to be described in detail later) can be collected at a position of a lower end of the inclined end surface and dropped therefrom, and the dropping position of the oil can be controlled.

Hereinafter, for convenience, unless otherwise specified, the blow-by gas pipe 10 and the outlet portion 9 also include the heat insulating member 14 around the blow-by gas pipe 10 and the outlet portion 9.

The outlet portion 9 is detachably fixed to a left side surface portion of the flywheel housing 13 via a binding band 15 and a bracket 16.

Meanwhile, the collection container 20 includes an upper end opening portion 22 formed at an upper end 21 of the collection container 20 and into which the outlet portion 9 is inserted from above, a discharge hole 24 formed in an upper portion of a rear surface portion 23 located on a rear side in a vehicle length direction of the collection container 20, and a cutout portion 26 formed in an upper portion of a side surface portion (left side surface portion 25) located on an outer side (left side) in a vehicle width direction of the collection container 20. The cutout portion 26 is cut out from a height position of the upper end 21 of the collection container 20 to a position lower than the outlet portion 9.

The upper end opening portion 22 is formed by entirely opening the upper end 21 or the upper surface of the collection container 20. Therefore, the collection container 20 is formed in a substantially rectangular parallelepiped box shape in which the upper end 21 is opened. The outlet portion 9 is inserted into the collection container 20 from the upper end opening portion 22 by a predetermined length. Therefore, a position of a lower end of the outlet portion 9 is lower than the upper end 21. The outlet portion 9 and the upper end portion of the collection container 20 overlap each other by a predetermined length in a height direction. Therefore, oil dropped from the outlet portion 9 can be prevented from going over the upper end 21 by a traveling wind and being discharged to the outside of the container.

The discharge hole 24 has a circular shape and a plurality of discharge holes 24 are provided. The discharge holes 24 are arranged in a staggered manner, and are provided only in an upper portion of the rear surface portion 23. This is because the oil collected in the container may leak out if the discharge holes are provided in a lower portion of the rear surface portion 23. In particular, the discharge holes 24 are intensively provided in a portion of the rear surface portion 23 having the same lateral width as that of the outlet portion 9 in a rear view. The shape, the number, the arrangement, and the like of the discharge holes 24 can be changed.

The cutout portion 26 is formed by cutting a corner portion, where the upper end 21 and the left side surface portion 25 intersect with each other, slightly obliquely with respect to an upper-lower direction. The cutout portion 26 is defined by a bottom side portion 27 that is formed in the left side surface portion 25 and extends horizontally in a front-rear direction, and a front oblique side portion 28 and a and rear oblique side portion 29. The front oblique side portion 28 connects a front end of the bottom side portion 27 and a front portion of the upper end 21, and the rear oblique side portion 29 connects a rear end of the bottom side portion 27 and a rear portion of the upper end 21. In a rear view, each of the front oblique side portion 28 and the rear oblique side portion 29 is inclined at a relatively small angle with respect to the upper-lower direction so as to be directed inward (rightward) in the vehicle width direction as going upward. The cutout portion 26 is continuous with the upper end opening portion 22. A right end position of the cutout portion 26, that is, upper end positions of the front oblique side portion 28 and the rear oblique side portion 29 are located outward (leftward) in the vehicle width direction with respect to the outlet portion 9.

An inclined surface portion 31 is formed at a lower portion of the right side surface portion 30 of the collection container 20 so as to follow an outer shape of the left side surface portion of the flywheel housing 13.

A container bracket 32 is fixed to a front surface portion of the collection container 20. On the other hand, another bracket, that is, a housing bracket 33 is attached to the flywheel housing 13 in advance. The container bracket 32 is detachably fixed to the housing bracket 33 by a plurality of (two in the present embodiment) bolts 34. Thus, the collection container 20 is detachably attached to the left side surface portion of the flywheel housing 13.

A plurality of introduction holes 35 that allow introduction of traveling wind are provided in the front surface portion of the collection container 20, but the introduction holes 35 may be omitted.

In the configuration in which the blow-by gas is released to the atmosphere as in the present embodiment, the oil contained in the blow-by gas is also released to the atmosphere from the outlet portion 9 of the blow-by gas pipe 10 together with the blow-by gas.

Therefore, if no countermeasure is taken, that is, if the collection container 20 is not provided, there is a possibility that components (particularly, the flywheel housing 13) around the outlet portion 9 and a road surface may be contaminated.

That is, the blow-by gas contains oil mist (very fine oil particles). When the oil mist gradually adheres to the inside of the blow-by gas pipe 10 and is collected into droplets, the droplets flow down along the inner surface of the blow-by gas pipe 10, and are dropped and discharged from the outlet portion 9. If the collection container 20 is not provided, there is a possibility that the components around the outlet portion 9 and the road surface directly below the outlet portion 9 may be contaminated by the discharged oil. Further, when the oil adheres to a component, oil leakage from the adhering portion may be erroneously recognized, which may lead to incorrect vehicle maintenance. Naturally, the appearance is also deteriorated.

The blow-by gas also contains steam, which may be mixed with oil to form a mixed liquid, and such a mixed liquid is also included within the oil causing the above-described problem.

In the present embodiment, since the collection container 20 is provided, the oil discharged from the outlet portion 9 can be reliably collected by the collection container 20. Therefore, components around the outlet portion 9 and the road surface can be prevented from being contaminated by the oil.

Since the collection container 20 of the present embodiment has a special shape as described above, the oil discharged from the outlet portion 9 can be treated in various modes according to a vehicle speed. This point will be described below.

FIG. 4 shows a flow of the gas in a state where the engine 1 is idle and the vehicle V is stopped (vehicle speed is zero), that is, in an idling stop state. The blow-by gas discharged from the outlet portion 9 swirls in the collection container 20 as indicated by a flow f1, then rises as indicated by a flow f2, and is discharged and diffused into an engine room outside the container mainly through the cutout portion 26. The oil mist in the blow-by gas discharged from the outlet portion 9 is also discharged and diffused to the outside of the container along with the flow of the blow-by gas. There are substantially no components in a vicinity of the upper side of the collection container 20, and therefore, adhesion of oil to a component is prevented.

Figure 5:
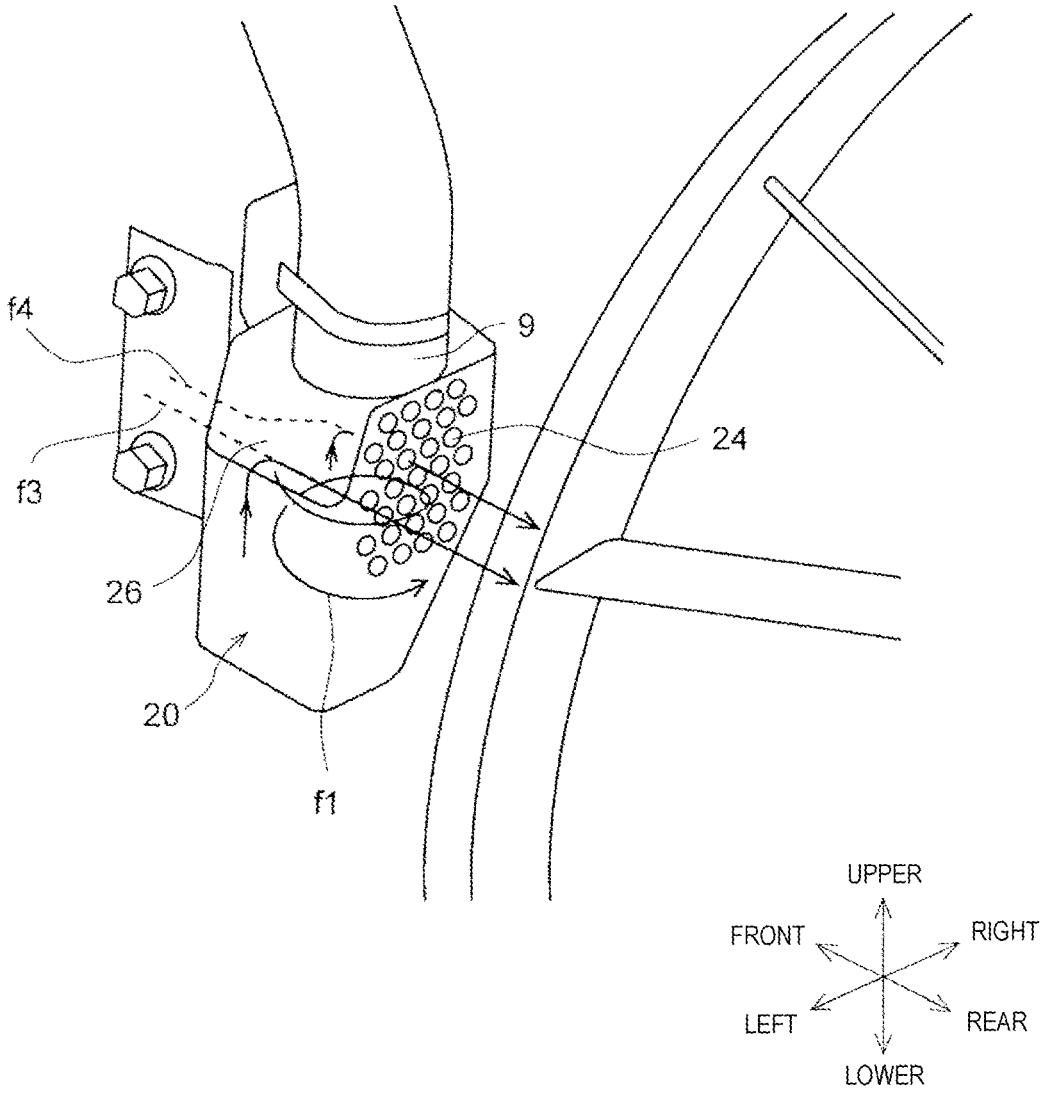
FIG. 5 is a rear perspective view illustrating a flow of gas in a low-speed traveling state.

FIG. 5 illustrates a flow of the gas in a state where the vehicle V is traveling at a relatively low speed, that is, in a low-speed traveling state. For example, the speed at this time is a speed at which a temperature of the engine is the highest and heat damage is concerned, and is, for example, 35 km/h.

At this time, since the vehicle is traveling, the traveling wind as indicated by flows f3 and f4 is generated. Since there are many components of the engine 1 in front of the collection container 20 (see FIG. 1), the traveling wind tends to pass through a vicinity on a left side of the collection container 20 from front to rear. A part (referred to as a first portion) f3 of the traveling wind passes across the cutout portion 26, and another part (referred to as a second portion) f4 of the traveling wind enters the container from the cutout portion 26 and is discharged from the discharge holes 24.

The blow-by gas discharged from the outlet portion 9 swirls in the same manner as the flow f1 in the collection container 20, and then is discharged to the outside of the container along with the flow of the traveling wind. A part of the blow-by gas flows rearward by riding on the first portion f3 of the traveling wind after exiting from the cutout portion 26, and the other part of the blow-by gas is discharged to the outside of the container from the discharge holes 24 by riding on the second portion f4 of the traveling wind. The oil mist in the blow-by gas discharged from the outlet portion 9 is also discharged and diffused to the outside of the container by riding on the flow of the blow-by gas.

As shown in FIG. 1, a width in the vehicle width direction of the clutch 6 adjacent to a rear side of the flywheel housing 13 is sequentially reduced from a width equal to that of the flywheel housing 13 toward the rear side, and a width of the transmission 7 is also narrower than that of the flywheel housing 13. Although not shown, heights of the clutch 6 and the transmission 7 also have the same tendency. Therefore, there is a large space, in which there are substantially no components, behind the collection container 20. In the present embodiment, since the oil mist is actively directed to the space behind the collection container 20 and discharged, adhesion of the oil to the components can be prevented.

Figure 6:
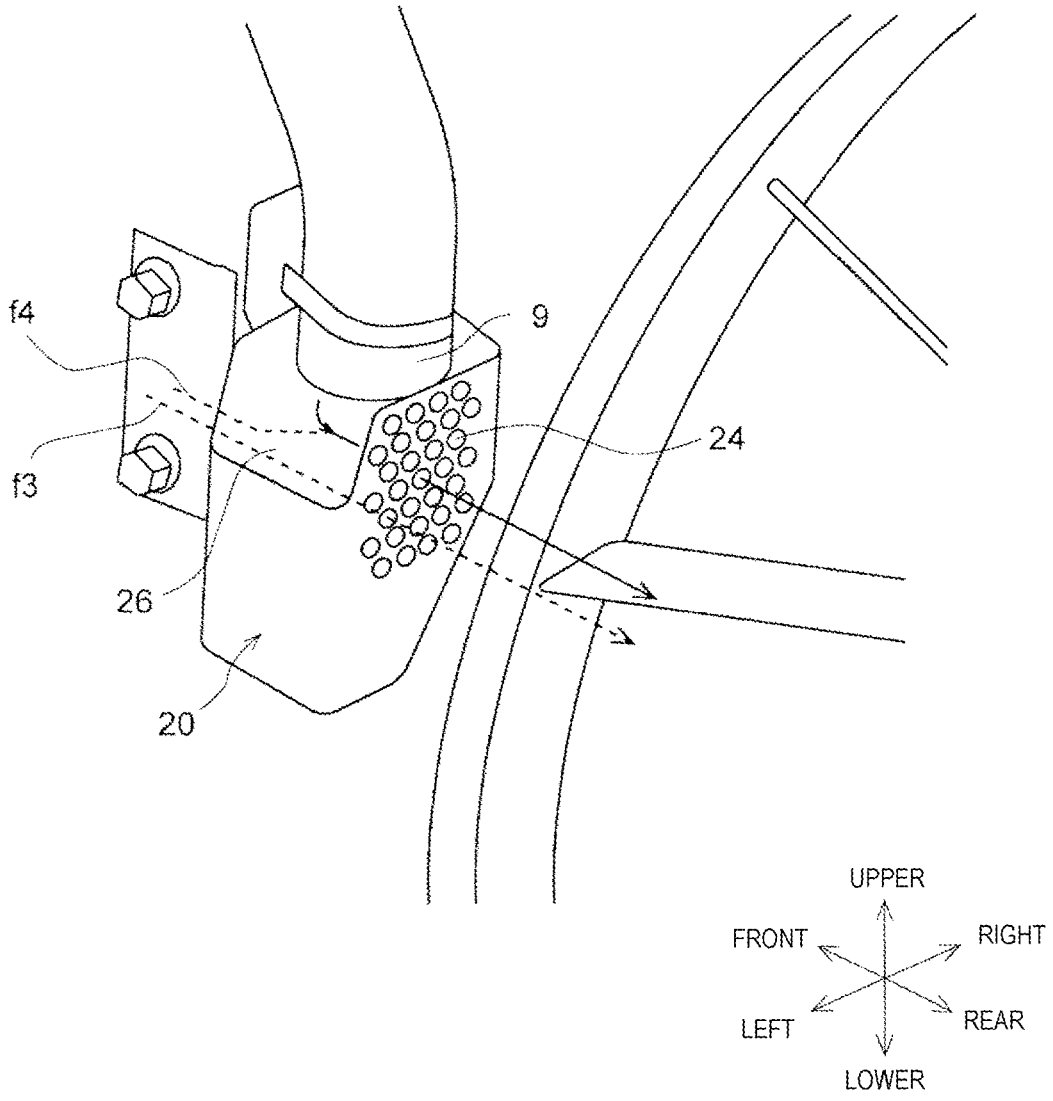
FIG. 6 is a rear perspective view illustrating a flow of gas in a high-speed traveling state.

FIG. 6 illustrates a flow of the gas in a state where the vehicle V is traveling at a relatively high speed, that is, in a high-speed traveling state. For example, the speed at this time is a speed near a maximum speed of the vehicle, and is, for example, 110 km/h.

At this time, the traveling wind has a considerably high speed. Similarly to the above, there are the first portion f3 passing through the vicinity on the left side of the collection container 20 and the second portion f4 entering the container from the cutout portion 26 and exiting from the discharge holes 24.

Immediately after the blow-by gas is discharged from the outlet portion 9, the blow-by gas rides on the second portion f4 and is immediately discharged from the discharge holes 24 to the outside of the container. The same applies to the oil mist in the blow-by gas, and the oil mist is discharged to a rear space where there are substantially no components. Therefore, the adhesion of the oil to the components can be prevented.

According to the present embodiment as described above, as illustrated in FIGS. 5 and 6, the flow (the second portion f4) of the traveling wind that enters the collection container 20 from the cutout portion 26 and exits from the discharge holes 24 can be generated. Then, the blow-by gas and the oil mist discharged from the outlet portion 9 rides on the flow of the traveling wind, and can be discharged rearward from the discharge holes 24. Therefore, the flow of the blow-by gas and the oil mist has directivity, and the blow-by gas and the oil mist can be reliably guided and discharged in a target direction (that is, rearward) in which the blow-by gas and the oil mist are unlikely to adhere to the components. Accordingly, the adhesion of the oil to the components can be prevented.

Since the cutout portion 26 is cut out to a position lower than the outlet portion 9, the traveling wind entering the collection container 20 from the cutout portion 26 can be allowed to pass directly below the outlet portion 9. Therefore, the blow-by gas discharged from the outlet portion 9 can immediately ride on the flow of the traveling wind and be discharged to the outside.

Further, as shown in FIG. 5, the blow-by gas and the oil mist that rise and then exit from the cutout portion 26 can be discharged rearward by riding on the first portion f3 of the traveling wind. Since the cutout portion 26 is obliquely cut out and defined by the front oblique side portion 28 and the rear oblique side portion 29, an opening area of the cutout portion 26 when viewed from above can be increased, and the blow-by gas that exits from the cutout portion 26 can be efficiently joined to the first portion f3 of the traveling wind. Thus, the blow-by gas and the oil mist can be efficiently discharged.

When an amount of the oil accumulated in the collection container 20 reaches a predetermined amount, the collection container 20 is detached by loosening the bolts 34, and thus an inside of the collection container 20 can be easily cleaned while recovering the collected oil.

Although the embodiment of the present disclosure have been described in detail above, various other embodiments and modifications of the present disclosure are conceivable.

(1) For example, the upper end opening portion 22 of the collection container 20 may not be formed by opening the entire upper end 21 of the collection container 20, and may be formed by a hole having a minimum size into which the outlet portion 9 of the blow-by gas pipe 10 can be inserted.

(2) The heat insulating member 14 around the blow-by gas pipe 10 may be omitted.

The embodiments of the present disclosure are not limited to the embodiments described above, and all modifications, applications, and equivalents which fall within the spirit of the present invention as defined by the claims are included in the present invention. Accordingly, the present disclosure should not be construed as being limited, and can be applied to any other technique belonging to the scope of the spirit of the present invention.

The present application is based on the Japanese patent application (Japanese Patent Application No. 2019-152883) filed on Aug. 23, 2019, and the contents thereof are incorporated herein as reference.

INDUSTRIAL APPLICABILITY

The blow-by gas treatment apparatus of the present disclosure is useful in the point that the components and the like can be prevented from being contaminated by the oil in the blow-by gas.

REFERENCE SIGNS LIST

V: Vehicle
1: Internal Combustion Engine (Engine)
8: Blow-by Gas Treatment Apparatus
9: Outlet Portion
10: Blow-by gas Pipe
13: Flywheel Housing
20: Collection Container
21: Upper End
22: Upper End Opening Portion
23: Rear Surface Portion
24: Discharge Hole
25: Left Side Surface Portion
26: Cutout Portion

The invention claimed is:

1. A blow-by gas treatment apparatus for an internal combustion engine mounted on a vehicle, the blow-by gas treatment apparatus comprising:

a blow-by gas pipe having a downward facing outlet portion opened to atmosphere; and a collection container into which the outlet portion of the blow-by gas pipe is inserted and which is configured to collect oil discharged from the outlet portion of the blow-by gas pipe, wherein the collection container includes:

an upper end opening portion formed at an upper end of the collection container and into which the outlet portion of the blow-by gas pipe is inserted from above, a discharge hole formed in an upper portion of a rear surface portion of the collection container, the rear surface portion being located on a rear side in a vehicle length direction, and a cutout portion formed at an upper portion of a side surface portion of the collection container, the side surface portion being located on an outer side in a vehicle width direction.

2. The blow-by gas treatment apparatus according to claim 1, wherein the cutout portion is cut out from a height position of the upper end of the collection container to a position lower than the outlet portion of the blow-by gas pipe.

3. The blow-by gas treatment apparatus according to claim 1, wherein a plurality of the discharge holes are provided.

4. The blow-by gas treatment apparatus according to claim 3, wherein the plurality of discharge holes are arranged in a staggered manner.

5. The blow-by gas treatment apparatus according to any claims 1, wherein the discharge hole is formed only in the upper portion of the rear surface portion of the collection container.

6. The blow-by gas treatment apparatus according to claims 1, wherein the internal combustion engine is disposed vertically on the vehicle, and wherein the collection container is configured to be detachably attached to a side surface portion of a flywheel housing of the internal combustion engine.

* * * * *